US008496149B1

(12) United States Patent
Sohm

(10) Patent No.: US 8,496,149 B1
(45) Date of Patent: Jul. 30, 2013

(54) HUNTING BLIND CARRYING ASSEMBLY

(75) Inventor: Michael Sohm, Great Bend, KS (US)

(73) Assignee: Magnus, Inc., Great Bend, KS (US)

( * ) Notice: Subject to any disclaimer, the term of this patent is extended or adjusted under 35 U.S.C. 154(b) by 324 days.

(21) Appl. No.: 12/723,821

(22) Filed: Mar. 15, 2010

(51) Int. Cl.

| | |
|---|---|
| ***A45F 3/00*** | (2006.01) |
| ***A45F 3/04*** | (2006.01) |
| ***A45F 4/02*** | (2006.01) |
| ***A45F 4/00*** | (2006.01) |

(52) U.S. Cl.
USPC ..... 224/633; 224/636; 224/649; 224/153; 224/586

(58) Field of Classification Search
USPC ..... 224/633, 153, 636, 586, 649
See application file for complete search history.

(56) References Cited

U.S. PATENT DOCUMENTS

| | | | | | |
|---|---|---|---|---|---|
| 139,731 | A * | 6/1873 | Palmer | 224/637 |
| 3,358,789 | A * | 12/1967 | Laun | 182/113 |
| 4,739,913 | A * | 4/1988 | Moore | 224/643 |
| 4,884,731 | A * | 12/1989 | Sibley | 224/651 |
| 5,277,349 | A * | 1/1994 | Rowe | 224/154 |
| 5,341,974 | A * | 8/1994 | Robinson et al. | 224/633 |
| 5,560,524 | A * | 10/1996 | Brune | 224/155 |
| 5,564,612 | A * | 10/1996 | Gregory | 224/633 |
| 5,579,966 | A * | 12/1996 | Krumweide et al. | 224/637 |
| 5,875,946 | A * | 3/1999 | Knudsen | 224/262 |
| 5,954,253 | A * | 9/1999 | Swetish | 224/631 |
| 5,957,355 | A * | 9/1999 | Swetish | 224/627 |
| 6,021,794 | A * | 2/2000 | Guerra | 135/95 |
| 6,135,334 | A * | 10/2000 | Seichter | 224/651 |
| 6,202,665 | B1 * | 3/2001 | O'Hare | 135/90 |
| 6,510,922 | B1 * | 1/2003 | Hodnett | 182/187 |
| 6,698,131 | B2 * | 3/2004 | Latschaw | 43/1 |
| 6,889,882 | B1 * | 5/2005 | Leep | 224/579 |
| 7,051,908 | B2 * | 5/2006 | Mignano | 224/153 |
| 7,246,630 | B1 * | 7/2007 | Ransom et al. | 135/90 |
| 7,735,503 | B2 * | 6/2010 | Jenkinson | 135/96 |
| 7,997,291 | B2 * | 8/2011 | Gressette et al. | 135/96 |
| 2006/0208024 | A1 * | 9/2006 | Gleason, Jr. | 224/633 |
| 2007/0012735 | A1 * | 1/2007 | Lee et al. | 224/155 |
| 2009/0127299 | A1 * | 5/2009 | Jamlang | 224/153 |

* cited by examiner

*Primary Examiner* — Nathan J Newhouse
*Assistant Examiner* — Lester L Vanterpool
(74) *Attorney, Agent, or Firm* — Kenneth H. Jack; Davis & Jack, L.L.C.

(57) ABSTRACT

A hunting blind assembly having a frame adapted for shoulder supported carriage; a collapsible hunting blind; a durable flexible sheet fitted for, upon movement of the hunting blind to its collapsed configuration and upon placement of the hunting blind in contact with the frame's back side, and between the frame's left and right ends, arcuately covering the hunting blind; and left and right pluralities of ties interconnecting the frame with the durable flexible sheet, the left and right pluralities of ties, in combination with the frame and the durable flexible sheet, encapsulating the hunting blind.

14 Claims, 3 Drawing Sheets

HUNTING BLIND CARRYING ASSEMBLY

FIELD OF THE INVENTION

This invention relates to collapsible and portable hunting blinds. More particularly, this invention relates to such hunting blinds and their associated structures and assemblies which are adapted for personal hunting blind carriage in the field.

BACKGROUND OF THE INVENTION

Commonly known collapsible hunting blinds are typically bulky and cumbersome to carry and transport in the field. A factor which further complicates and makes more difficult the hunter's task of carrying a collapsible hunting blind in the field is that such blinds typically comprise a multiplicity of structural support rods which are subject to bending, deformation, or fracturing upon rough contact with foreign objects and use during carriage and transportation in the field.

Another factor complicating and making more difficult hunters' carriage and transportation of collapsible hunting blinds in the field is the fact that such blinds' woven fabric covering material easily becomes abraded or damaged upon sharp impingement against or compressive contact exerted by outside structures and objects. Where such impinging contact coincides with the location within a collapsed hunting blind of an underlying support rod or rod connecting joint, cutting of the blind's fabric covering often undesirably occurs.

The instant inventive hunting blind assembly solves or ameliorates the problems, difficulties, and deficiencies discussed above by providing a special shoulder carried frame structure which, in combination with a specialized flexible sheet and tie combination may securely compressively envelope and hold a hunting blind in its collapsed configuration and upon a carry frame while both avoiding damage to the blind's structural support rods, and avoiding any impingement or compression damage to the blind's covering material.

BRIEF SUMMARY OF THE INVENTION

A first structural component of the instant inventive hunting blind assembly comprises a frame having left and right ends, a front side, and a back side. In a preferred embodiment, the frame is vertically oblongated and is sized in conformity with a typical camper's back pack frame. Such frame preferably comprises aluminum tubing. Suitably, the frame may alternatively comprise a matrix of lightweight and durable carbon fiber composite members. Also suitably though less desirably, the frame may alternatively comprise a matrix of steel bars or tubes. Preferably, the frame component of the instant invention further comprises left and right shoulder straps and a waste support strap, such straps being fixedly attached to and extending forwardly from the frame.

A further structural component of the instant inventive hunting blind assembly comprises a dome shaped or but shaped blind which is adapted and configured for alternatively expanding to an interior space defining use configuration and collapsing to a vertically oblongated, or substantially cylindrical shaped, transport configuration. In the preferred embodiment, the hunting blind comprises a matrix of pivotably interlinked support rods or struts and a fabric cover fitted for defining the interior concavity, the support rods being connected operatively to the inner surfaces of such fabric cover. The support rods may suitably comprise aluminum tubes, fiberglass shafts, or carbon fiber composite shafts.

A further structural component of the instant inventive hunting blind comprises a durable flexible sheet having left, right, and lower edges. Preferably, the durable flexible sheet is composed of heavy duty woven nylon fiber. Suitably, the durable flexible sheet may comprise other synthetic fibers or may comprise cotton fiber canvas. In the preferred embodiment, the durable flexible sheet is rectangularly fitted and sized between two and three feet in lateral width, and between three feet and four feet in vertical length, such fitting allowing the flexible sheet to, upon placement against the hunting blind in its collapsed position, arcuately curve over and cover a substantial portion of the hunting blind's cylindrical body.

A further structural component of the instant inventive hunting blind assembly comprises left and right pluralities of flexible ties which are adapted for respectively securely interconnecting the left and right edges of the durable flexible sheet with the left and right sides of the vertically oblongated frame. In the preferred embodiment, each flexible tie comprises a heavy duty strap composed of woven synthetic fibers. Each such strap is preferably divided into proximal and distal sections, such sections preferably being interconnected by a quick releasing buckle. The assembly's quick release buckles preferably comprise male and female halves, the male halves presenting spring hooks, and the female halves presenting spring hook engaging edge surfaces and associated fingertip apertures for manual spring hook disengagement. Also in the preferred embodiment, each such quick release buckle includes or presents strap turn back loops which are adapted for strap take up and binding for secure strap tightening.

Also in the preferred embodiment of the instant inventive hunting blind assembly, the durable flexible sheet is configured to present or include dual or front and rear layers, the durable flexible sheet's rear layer preferably being attached or sewn to the front layer at left and right sides and at a lower end to form an equipment carrying concavity or closure. Preferably, the front layer is exclusively tensioned by the left and right pluralities of ties, while the rear layer arches loosely over the front layer. Releasable closing means selected from the group consisting of zippers, "velcro", type flexible hook and hook engaging loop pad combinations, snap fasteners, and button and buttonhole combinations are preferably connected operatively to such closure.

In use of the instant inventive hunting blind, and assuming the provision of preferred components and structures, as described above, a hunter may initially lay the assembly's vertically oblongated carry frame component so its front side faces the ground, and so that the proximal segments of the assembly's left and right strap ties extend laterally leftwardly and rightwardly therefrom. Thereafter, the hunter may be manually manipulate the hunting blind component to assume its vertically oblongated transport configuration.

Where the hunting blind includes a protective storage bag, the collapsed blind is preferably placed within such bag.

Thereafter, the hunter may place the hunting blind against the frame's back side orienting the hunting blind's vertical dimension with the frame's vertical dimension, and aligning the hunting blind between the frame's left and right sides. Thereafter, the hunter may place the durable flexible sheet component over the hunting blind, allowing the durable flexible sheet to arcuately curve over and to substantially envelope the middle portion of the hunting blind's cylindrical body.

Thereafter, the frame connected proximal sections of the left and right ties may be engaged with the flexible sheet connected distal sections of such ties, each tie's male and female buckle halves being manually interconnected. Thereafter, the flexible straps may be manually back pulled and tightened through the buckles' turn back loops, the strap pulling step evenly and compressively tightening the durable flexible sheet's arcuate extension over the hunting blind. Such evenly applied pressure exerted by the straps and the durable flexible sheet to the hunting blind advantageously securely compresses the hunting blind forwardly into and onto the frame, holding the hunting blind on the frame without damaging the hunting blind's interior support rods, and without the exertion of any sharp compressive contact against the hunting blind's fabric cover. Thus, the assembly securely holds the hunting blind for carriage in the field without damage.

Since the forward portion of the preferred dual flexible sheet is exclusively tensioned by the straps, hard objects such as ground spikes may be stored within the sheet's formed pocket without any impingement damage to the underlying hunting blind.

Accordingly, objects of the instant invention include the provision of a hunting blind assembly which incorporates or includes structures, as described above, and which interconnects and associates those structures with each other in manners as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
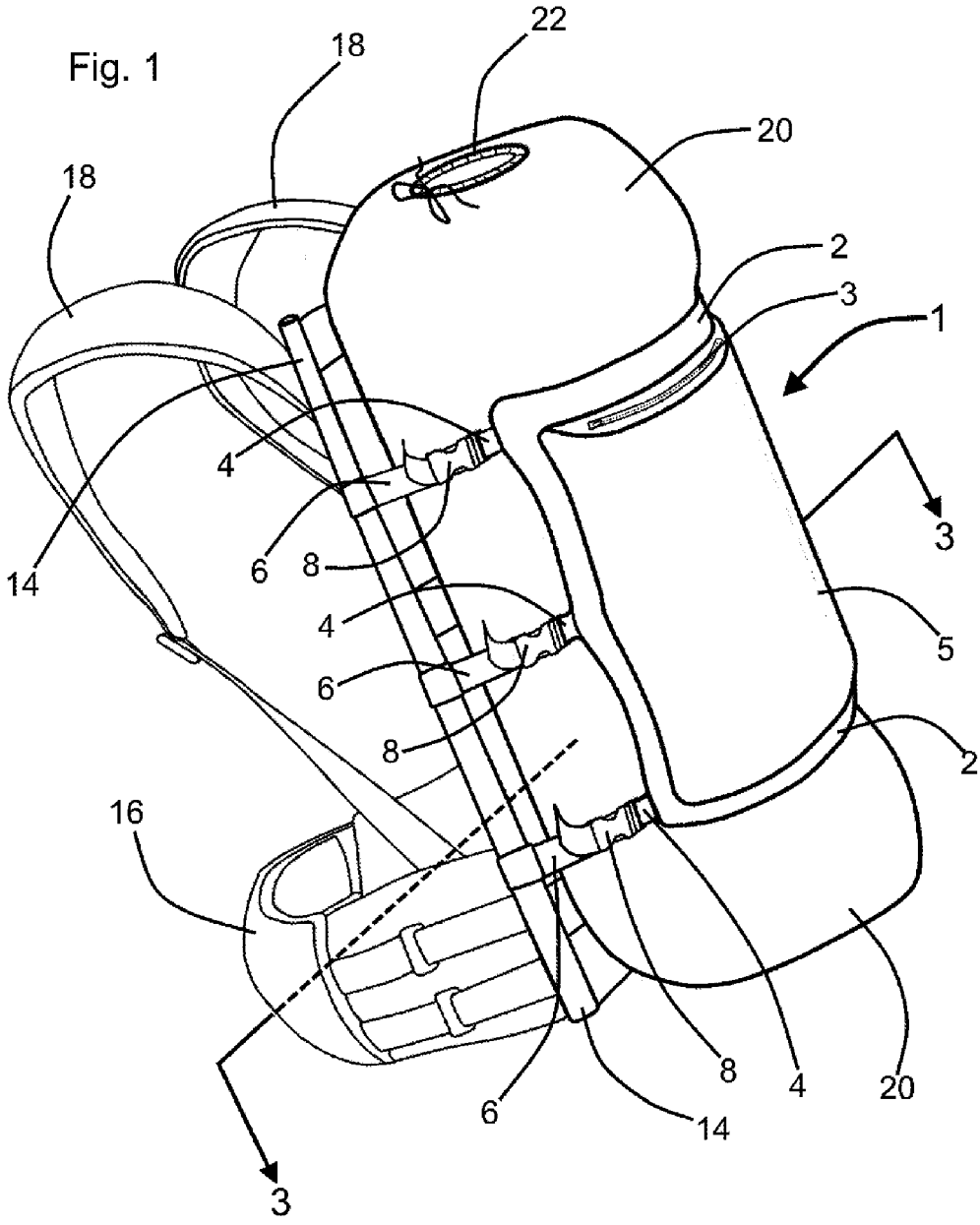
FIG. 1 is a perspective view of a preferred embodiment of the instant inventive hunting blind assembly.
Figure 2:
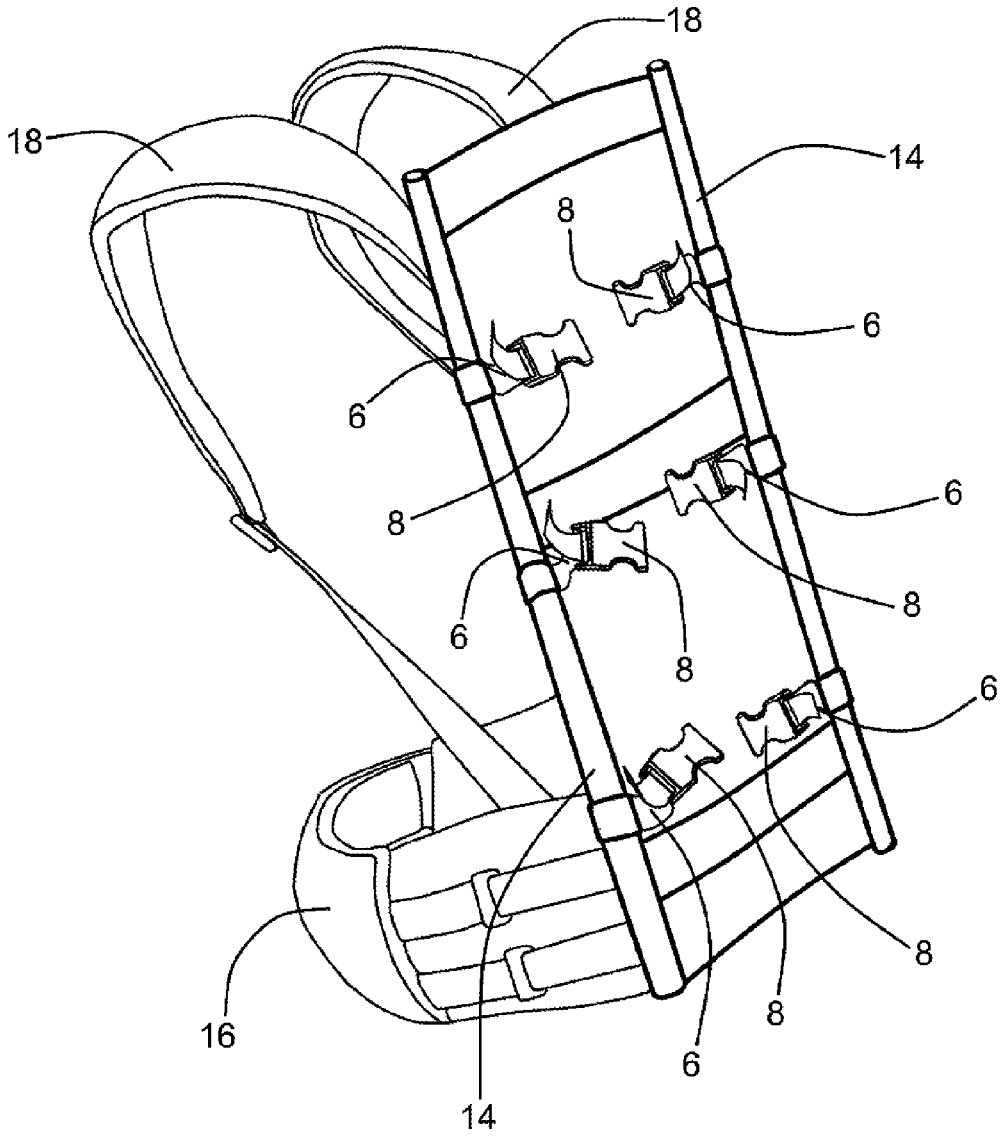
FIG. 2 redepicts FIG. 1, the view of FIG. 2 showing the invention's hunting blind component removed.

Referring now to the drawings, and in particular to FIGS. 1 and 2, a preferred embodiment of the instant inventive hunting blind assembly is referred to generally by Reference Arrow 1. The hunting blind assembly comprises a vertically oblongated frame 14 which preferably is composed of aluminum or lightweight carbon fiber composite. Suitably, the frame 14 may alternatively comprise steel bars or tubes. Conventional shoulder straps 18 and a hip belt 16 are preferably fixedly attached to and extend forwardly from the frame 14.

Figure 3:
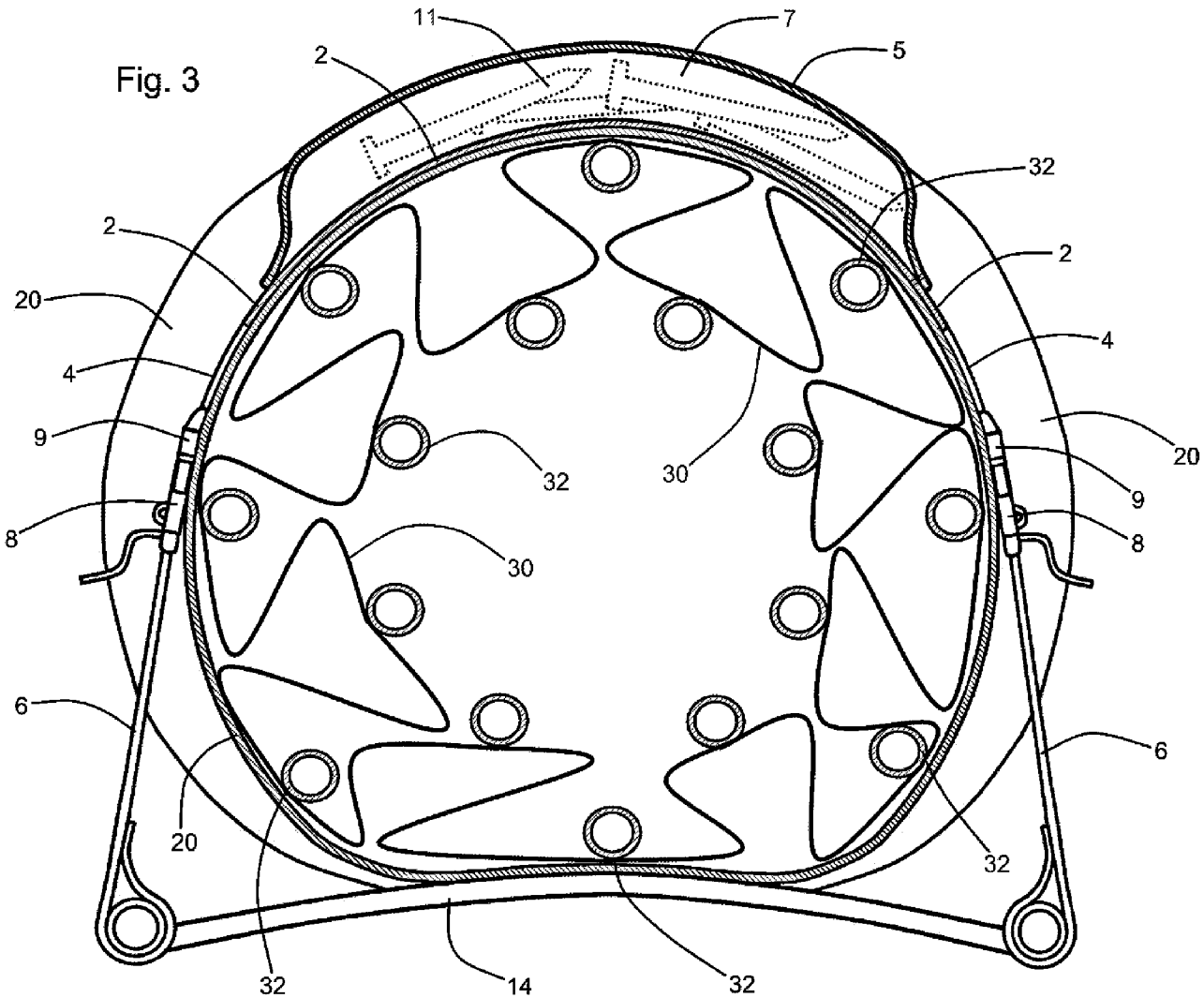
FIG. 3 is a sectional view as indicated in FIG. 1.

Referring simultaneously to FIGS. 1 and 3, a collapsible and expandable hunting blind consisting of a pivoting matrix of support rods 32, a fabric cover 30, and a storage bag 20 is capable of alternatively expanding to a dome shaped use configuration and collapsing to the vertically oblongated transport configuration depicted in FIG. 1. The protective storage bag 20 has a drawstring closable upper opening 22.

A durable flexible sheet front portion 2, preferably comprises woven nylon fiber. Such sheet portion 2 is preferably fitted for arcuately curving over and enveloping the hunting blind, as indicated in FIGS. 1 and 2. Left and right pluralities of flexible ties are preferably provided, each tie preferably comprising proximal and distal strap segments 6 and 4. The extreme proximal or forward end of each proximal strap segment 6 is preferably looped about and is fixedly attached to a vertically extending member of frame 14. Correspondingly, the extreme distal or rearward end of the distal segment 4 of each strap is preferably fixedly attached or sewn to a side edge of the durable flexible sheet portion 2.

Quick release buckles 8 and 9 are preferably provided for interconnecting the straps' proximal and distal sections 6 and 4. Each quick release buckle 8 and 9 is preferably of the type including, referring in particular to FIG. 3, a male half 9 and a female half 8, each male half presenting a flexible spring hook, and each female half presenting spring hook engaging fingertip insertion apertures. The quick release buckles 8 and 9 preferably present turn back loops allowing the flexible straps to be threaded therethrough for turn back binding and tightening.

In use of the instant inventive hunting blind assembly, referring in particular to FIG. 2, the frame 14 may be initially placed upon the ground, with its front side facing downward. Thereafter, the six proximal strap sections 6 and their female quick release buckle halves 8 may be extended leftwardly and rightwardly outwardly clearing the frame 14 for receipt of the blind. Thereafter, referring further to FIG. 1, the hunter may place the hunting blind upon the exposed back side of the frame 14 in the vertically aligned orientation depicted in FIG. 1. Thereafter, referring further to FIG. 3, the durable flexible sheet portion 2 may be arcuately extended over the hunting blind, and the male buckle halves 9 at the ends of the distal strap segments 4 may be securely engaged with the female buckle halves 8.

Thereafter, the hunter may back pull the proximal strap segments 6 through the buckle's turn back loops, tightening the durable flexible sheet portion 2 in an arcuately curved fashion over and forwardly into the hunting blind. Such arcuately curved and forward compressive pressure advantageously securely holds the hunting blind upon the frame 14. As is shown in FIG. 3, such pressure avoids the exertion of any excessively localized bending or deflecting pressure upon the support poles 32, while also avoiding any sharp impinging or excessive pressure between the durable flexible sheet portion 2, the blind sack 20, and the blind's cover material 30. Accordingly, the instant inventive assembly securely holds the hunting blind upon the frame 14 without any damage to the pole structure or covering of the hunting blind.

Referring simultaneously to FIGS. 1 and 3, in the preferred embodiment of the instant inventive assembly, the durable flexible sheet is configured to include both the forward layer 2 and a rearward layer 5, the rearward layer 5 being attached by stitching at its left and right sides and at its lower end. Such inner forward and rearward layers configuration advantageously allows the durable flexible sheet to form an equipment carrying or stowing pocket or closure 7. For example, ground spikes 11 may be stored within the interior space 7. Since the forward layer 2 of the flexible sheet is exclusively tensioned by the straps 4 and 6, damaging impingement of the spikes against the blind is avoided. Closing means 3 are preferably attached to the upper end of the closure 7, such closing means being representative of zippers, snap fasteners, buttons and buttonhole combinations, and "velcro" type flexible hook and hook engaging loop pad combinations.

While the principles of the invention have been made clear in the above illustrative embodiment, those skilled in the art may make modifications in the structure, arrangement, portions and components of the invention without departing from those principles.

Accordingly, it is intended that the description and drawings be interpreted as illustrative and not in the limiting sense, and that the invention be given a scope commensurate with the appended claims.

I claim:

1. A hunting blind assembly comprising:

(a) a vertically oblongated carry frame having left and right ends, a front and a back, the carry frame being adapted for shoulder support;

(b) a vertically oblongated hunting blind, the vertically oblongated hunting blind comprising a plurality of vertically extending support rods, each vertically extending support rod having a medial portion, the vertically oblongated hunting blind further comprising a flexible fabric cover fixedly attached to the plurality of vertically extending support rods and a flexible fabric storage bag receiving the vertically extending support rods and the flexible fabric cover, the vertically oblongated hunting blind being adapted for expanding to an interior space defining use configuration, the vertically oblongated hunting blind having an upper end, a lower end, and a medial portion between the upper and lower ends;

(c) a durable flexible sheet having left, right, and lower edges, the durable flexible sheet being fitted for, upon placement of the vertically oblongated hunting blind in contact with the carry frame's back side and between the carry frame's left and right ends, arcuately covering the medial portion of the vertically oblongated hunting blind; and (d) left and right pluralities of tensioned ties respectively interconnecting the carry frame's left and right ends with the durable flexible sheet's left and right edges, the left and right pluralities of tensioned ties inwardly impinging the durable flexible sheet against the flexible fabric storage bag, against the flexible fabric cover, and against the plurality of vertically extending support rods, the carry frame and the durable flexible sheet encapsulating the medial portion of the vertically oblongated hunting blind at the carry frame's back side; the encapsulated medial portion of the vertically oblongated hunting blind, the upper end of the vertically oblongated hunting blind and the lower end of the vertically oblongated hunting blind, each having a diameter, the diameter of the encapsulated medial portion of the vertically oblongated hunting blind being less than the diameter of the upper and lower ends of the vertically oblongated hunting blind, the tensioned ties' inward impingement of the durable flexible sheet holding the vertically extending support rods' medial portions at the encapsulated medial portion's lesser diameter.

2. The hunting blind assembly of claim 1 wherein the hunting blind's support rods are arranged in a pivoting matrix.

3. The hunting blind assembly of claim 2 wherein the hunting blind's fabric cover has an interior surface, the matrix of pivoting support rods being connected operatively to the fabric cover's interior surface.

4. The hunting blind assembly of claim 3 wherein each tie among the plurality of ties comprises a flexible strap.

5. The hunting blind assembly of claim 4 wherein each flexible strap comprises interconnected proximal and distal sections.

6. The hunting blind assembly of claim 5 wherein each flexible strap further comprises a buckle releasably interconnecting said each flexible strap's proximal and distal sections.

7. The hunting blind assembly of claim 6 wherein each buckle has male and female halves, each male half comprising a spring hook and each female half comprising a hook engaging and releasing fingertip aperture.

8. The hunting blind assembly of claim 5 wherein each buckle further comprises a strap tensioning turn back loop.

9. The hunting blind assembly of claim 1 wherein each plurality of ties among the left and right pluralities of ties comprises a first tie, a second tie, and a third tie.

10. The hunting blind assembly of claim 1 wherein the durable flexible sheet comprises forward and rearward layers, the durable flexible sheet's rearward layer being attached to the forward layer along the forward layer's left, right, and lower edges.

11. The hunting blind assembly of claim 10 wherein the durable flexible sheet's rearward layer forms, in combination with the durable flexible sheet's forward layer, and upwardly opening closure.

12. The hunting blind assembly of claim 11 further comprising releasable closing means operatively connected to the durable flexible sheet's upwardly opening closure.

13. The hunting blind assembly of claim 12 wherein the releasable closing means comprises a fastener selected from the group consisting of zippers, flexible hook pad and hook engaging loop pad combinations, snap fasteners, and button and button hole combinations.

14. The hunting blind assembly of claim 10 wherein each tie among the left and right pluralities of ties is adapted for manual tightening, and wherein the forward and rearward layers of the flexible sheet are configured with respect to each other so that, upon such manual tightening, tension is transmitted substantially exclusively to the forward layer.

* * * * *